US006390860B2

(12) United States Patent
Shirouzu et al.

(10) Patent No.: US 6,390,860 B2
(45) Date of Patent: May 21, 2002

(54) CONNECTOR WITH A TERMINAL DEFLECTION PREVENTING MECHANISM

(75) Inventors: Kouichi Shirouzu, Aichi; Kei Sato, Shizuoka; Satoru Shindoh; Hidehisa Yamagami, both of Kanagawa, all of (JP)

(73) Assignees: Yazaki Corporation, Tokyo; AMP (Japan), Ltd., Kawasaki, both of (JP)

( * ) Notice: Subject to any disclaimer, the term of this patent is extended or adjusted under 35 U.S.C. 154(b) by 0 days.

(21) Appl. No.: 09/402,996

(22) PCT Filed: Apr. 17, 1998

(86) PCT No.: PCT/JP98/01779

§ 371 Date: Oct. 15, 1999

§ 102(e) Date: Oct. 15, 1999

(87) PCT Pub. No.: WO98/48484

PCT Pub. Date: Oct. 29, 1998

(30) Foreign Application Priority Data

Apr. 18, 1997 (JP) ..... 9-101946

(51) Int. Cl.[7] ..... H01K 13/40
(52) U.S. Cl. ..... 439/752.5; 439/595
(58) Field of Search ..... 439/595, 746, 439/748, 752.5, 733.1, 382

(56) References Cited

U.S. PATENT DOCUMENTS 4,979,912 A * 12/1990 Shindo et al. ..... 439/595
5,226,839 A * 7/1993 Koumatsu et al. ..... 439/595
5,520,548 A 5/1996 Hotea et al.
5,573,430 A 11/1996 Hatagishi
5,743,771 A * 4/1998 Yamaguchi et al. ..... 439/752.5
5,885,106 A * 3/1999 Gental et al. ..... 439/595
5,910,031 A * 6/1999 Goto ..... 439/752.5

FOREIGN PATENT DOCUMENTS

| | | |
|---|---|---|
| EP | 0 693 798 A1 | 1/1996 |
| EP | 0 708 499 A2 | 4/1996 |
| JP | 57-49908 | 11/1982 |
| JP | 59-36857 | 10/1984 |
| JP | 59-37973 | 10/1984 |
| JP | 8-162191 | 6/1996 |

* cited by examiner

*Primary Examiner*—P. Austin Bradley
*Assistant Examiner*—Edwin A. León
(74) *Attorney, Agent, or Firm*—McGinn & Gibb, PLLC

(57) ABSTRACT

A connector includes a vibration preventing piece is provided on the side surface of a connecting section between an elongated tab-shaped contact section provided at one end of a connecting terminal and a locking section at the middle, in such a manner that it is flush with the side surface of the locking section and extended towards the tab-shaped contact section. A contact recess is formed in the contact section engaging hole which is formed in the contact section engaging hole which is formed in a housing, so that, when the connecting terminal is inserted into the terminal accommodating chamber, the vibration preventing piece of the connecting terminal is abutted against the contact recess in the contact engaging hole.

7 Claims, 14 Drawing Sheets

CONNECTOR WITH A TERMINAL DEFLECTION PREVENTING MECHANISM

TECHNICAL FIELD

This invention relates to a connector having a terminal vibration preventing mechanism which is applied to an automobile or the like, and more particularly to a connector having a terminal vibration preventing mechanism which is used at a low current electrical connection section of an automobile or the like.

BACKGROUND ART

A conventional connector used at a low current electrical connection section is as shown in FIGS. 18 through 23.

In FIG. 18, reference numeral 270 designates a male type connecting terminal which is inserted into a connector which is used in a conventional low current electrical connection section. The connecting terminal 270 is made of a metal plate as one unit, and its one end portion is a tab-shaped contact section 171 while its other end portion is wire punching section. The wire punching section is made up of a cover punching section 272*a* adapted to punch the cover portion of a wire 290, and a conductor punching section 272*b* adapted to punch the conductor of the wire.

The connecting terminal 270 includes a substantially box-shaped locking section 273 at the middle, a locking hole 274 formed in the lower surface of the locking section 273, and a guide piece 275 which is formed by cutting and raising a part of the lower surface in such a manner that the guide piece 275 is protruded downwardly from a part of the side surface. Furthermore, with respect to the locking section 273 and the tab-shaped contact section 271, the upper surface thereof is lower on the tab-shaped contact section side, and the right and left side surfaces are narrower on the tab-shaped contact section side. And the locking sections 273 and the contact section 271 are coupled through a coupling section 276 which is symmetrical.

FIG. 19 is a sectional side view of a housing 260 forming the connector. FIG. 20 is a view of the housing taken in the direction of the arrow A in FIG. 19. FIG. 21 is an enlarged view of essential parts of the housing (FIG. 19) taken in the direction of the arrow A in FIG. 19. FIG. 22 is an enlarged sectional view showing another example of the housing (FIG. 21). FIG. 23 is an explanatory diagram for a description of the vibration of the connecting terminal which occurs when the connecting terminal is inserted into the connector.

As shown in FIGS. 19 through 23, the housing 260 is substantially cylindrical. The housing 260 has a plurality of terminal accommodating chambers 261, and a hood section 262 which is extended from the terminal accommodating chambers. The latter 261 are adapted to accommodate connecting terminals which is connected to wires. The hood section 262 accommodates the mating connector. On the lower surface 263 of each of the terminal accommodating chambers 261, a flexible locking piece 264 and an guide groove 265 are provided. The flexible locking piece 264 is extended inwardly from the inserting inlet of the connecting terminal 170. The guide groove 265 is formed along the flexible locking piece. The guide piece 175 of the connecting terminal 270 is slid along the guide groove 265.

The free end portion of the flexible locking piece 264 of the terminal accommodating chamber 261 has a locking protrusion 266, and a flexible space 267 is formed below the latter 266. The hood section 26 has a upright inner wall 268 at the deep. The inner wall 268 has a plurality of contact section engaging holes 269. Through the latter 269, the tap-shaped contact sections of the contact terminals 270 (which are accommodated in the terminal accommodating chambers 261) are protruded into the hood section 262. FIG. 21 is an enlarged sectional view showing the configuration of the contact section engaging hole 269 shown in FIG. 20; more specifically, the relationships between the tab-shaped contact section 271 and the inner wall 268.

In the above-described connector, the housing 260 and the connecting terminal 270 are constructed as described above. Hence, when the connecting terminal 270 is inserted into the terminal accommodating chamber 261 of the housing 260, the lower surface of the locking section 273 of the connecting terminal bends the flexible locking piece 264 downwardly (in the direction of the arrow B) which is provided on the lower surface of the terminal accommodating chamber 261, so that the connecting terminal is allowed to move forwardly. When the locking hole 274 formed in the lower surface of the locking section comes to the locking protrusion 266 which is formed at the free end portion of the flexible locking piece, the locking protrusion is allowed to rise, thus engaging with the locking hole 274. Hence, the connecting terminal 270 is supported in the terminal accommodating chamber 261, and is prevented from coming off the latter 261.

However, as was described above, when the locking protrusion 266 of the flexible locking piece 264 is engaged with the locking hole 274 of the connecting terminal 270, the connecting terminal 270 is prevented from coming off the terminal accommodating chamber 261, and therefore it is vibrated in the direction of bending of the flexible locking piece 264. Hence, as shown in FIG. 23, the tab-shaped contact section 271 of the connecting terminal 270 is swung in the contact section engaging hole 269 formed in the inner wall 268, thus being inclined θ degrees with respect to the central line C of the regular position; that is, so-called "terminal vibration" occurs.

This problem may be solved by employing the following method: The width of the contact engaging hole 269 is made equal to the width of the tab-shaped contact section 271 as much as possible, or the latter is engaged with the former in a press-fit mode; however, the latter method makes the insertion characteristic of the connector.

On the other hand, because of the recent tendency of miniaturization of connecting terminals, the width of the locking protrusion 266 of the flexible locking piece 264 is substantially equal to the width of the tab-shaped contact section 271 of the connecting terminal 270, or the width of the tab-shaped contact section 271 is decreased, and the width of the contact section engaging hole 269 of the inner wall has the same dimension. Therefore, if a flexible space for the flexible locking piece 264 is obtained, then it is impossible to obtain a space for correcting the vibration of the terminal. For instance, as shown in FIG. 22, by decreasing the width of the flexible locking piece 264 the space for correcting the vibration of the terminal can be obtained; however, the holding force of the flexible locking piece 264; that is, the connecting terminal 270 may come off backwardly.

DISCLOSURE OF THE INVENTION

Accordingly, an object of the invention is to correct the postures of the connecting terminals in the housing, and to positively support the connecting terminals in the housing, thereby to prevent the end portions of the connecting terminals from being vibrated from their regular positions.

The foregoing object of the invention has been achieved by the provision of a connector having a vibration preventing mechanism which comprises:

a connecting terminal which is inserted into the terminal accommodating chamber of a resin housing, and comprises an elongated tab-shaped contact section which is inserted into a hood section, a fixing section adapted to fix the end portion of a wire, and a locking section having locking hole in the lower surface of the substantial middle portion thereof which is engaged with a flexible locking piece formed in the housing, and a contact section engaging hole formed in the inner wall forming the deep section of the hood section which is adapted to engaged with an mating connector, and in which the tab-shaped contact section is inserted;

in which near the junction of the tab-shaped contact section of the connecting terminal and the locking section, a vibration preventing piece is formed which extends towards the tab-shaped contact section, and in the side surface of the contact section engaging hole in the housing, a support section is formed against which the vibration preventing piece is abutted.

In the connector with the terminal vibration preventing mechanism, near the joint of the elongated tab-shaped contact section provided at one end of the connecting terminal and the locking section provided substantially at the middle, the vibration preventing piece is formed in such a manner that it is extended towards the tab-shaped contact section on the side surface of the locking section, and the support section against which the vibration preventing piece of the connecting terminal abuts is formed in the contact section engaging hole formed in the inner wall of the housing.

Accordingly, the vibration preventing piece is wider than the tab-shaped contact section provided on the side surface of the joint of the elongated tab-shaped contact section provided at one end of the connecting terminal and the locking section provided substantially at the middle. When the tap-shaped contact section thus constructed is inserted in the terminal accommodating chamber of the housing, it is abutted against the support section of the contact section engaging hole of the housing, so that the connecting terminal is positively supported. Hence, the posture of the connecting terminal is corrected, and the terminal vibration that would shift the terminal from the regular position is positively prevented, so that it is engaged suitably with the mating connecting terminal.

Furthermore, when the vibration preventing piece which is larger in width than the tab-shaped contact section is inserted into the terminal accommodating chamber of the housing, the vibration preventing piece goes therein while the vibration preventing piece is abutting against the side wall of the terminal accommodating chamber. Hence, the end of the tab-shaped contact section is held at the regular position. Therefore, the end of the tab-shaped contact section can be readily inserted into the contact section engaging hole; that is, the work of inserting the connecting terminal into the terminal accommodating chamber is achieved smoothly and quickly.

Furthermore, the above-described object of the invention is achieved by making the width of the tab-shaped contact section equal to or smaller than the width of the flexible locking piece.

In the above-described connector with the terminal vibration preventing mechanism, the width of the tab-shaped contact section is made equal to or smaller than that of the flexible locking piece. Both the connecting terminal and the housing can be smoothly miniaturized.

Furthermore, the above-described object of the invention is achieved by the provision of the connector in which the vibration preventing piece of the tab-shaped contact section is supported by the support section in a press-fit mode.

In the above-described connector with the terminal vibration preventing mechanism, the vibration preventing piece of the tab-shaped contact section is press-fitted in the support section and positively supported. Hence, the posture of the connecting terminal thus inserted is corrected, and the connecting terminal is positively prevented from being vibrated, and the is suitably engaged with the mating connecting terminal.

Moreover, the above-described object of the invention is achieved by the provision of a connector having a vibration preventing mechanism which comprises a tab-shaped contact section which is contactable with a mating connecting terminal a locking section which, when accommodated in a connector housing, is engaged with a terminal accommodating, and a coupling section through which the locking section is coupled to the tab-shaped contact section, and in which the tab-shaped contact section is made up of a lower metal plate, and an upper metal plate which is formed by folding one side edge portion of the lower metal plate, and a connecting terminal is inserted in which the joint of the lower metal plate and the upper metal plate is faced sidewardly at the position along the opposite side edge;

in which, according to the invention, a vibration preventing piece which abuts against the connector housing to prevent the vertical vibration of the end of the tab-shaped contact section is protruded near the coupling section of the tab-shaped contact section.

In the above-described connector with the terminal vibration preventing mechanism, the vibration preventing piece which abuts against the connector housing to prevent the vertical vibration of the end of the tab-shaped contact section is protruded from near the coupling section of the tab-shaped contact section.

Accordingly, with the vibration preventing piece of the connecting terminal which is inserted into the housing abutted against the housing, the posture of the connecting terminal thus inserted is corrected, and the connecting terminal is prevented from being vibrated, and is suitably engaged with the mating connecting terminal.

In addition, the above-described object of the invention is achieved by the provision of the connector having the vibration preventing mechanism, in which, according to the invention, the vibration preventing piece is protruded from the side edge of the tab-shaped contact section where the joint of the upper metal plate and the lower metal plate is located.

In the above-described connector with the terminal vibration preventing mechanism, the vibration preventing piece is protruded from side edge of the tab-shaped contact section where the joint of the upper and lower metal plates is located.

Accordingly, the vibration preventing piece can be manufactured readily by blanking and bending a metal piece, which contributes to a reduction of the manufacturing cost of the connector.

BRIEF DESCRIPTION OF THE DRAWINGS

FIG. 11 is a fragmentary side view of the connecting terminal as viewed in the direction opposite to the direction in which FIG. 10 is viewed.

BEST MODE FOR CARRYING OUT THE INVENTION

Figure 1:
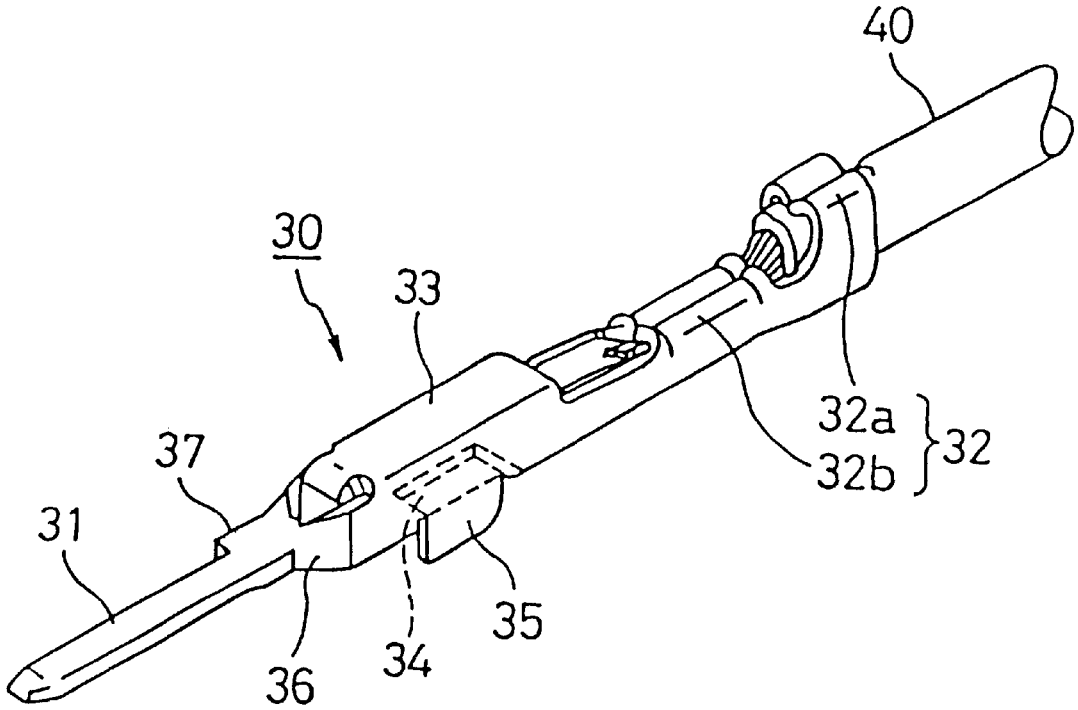
FIG. 1 is a perspective view of a connecting terminal which is inserted in a connector with a terminal vibration preventing mechanism according to the invention.

Preferred embodiments of the invention will be described with reference to FIGS. 1 through 17, parts corresponding functionally to those already described with reference to the above-described prior art are therefore designated by the same reference numerals or characters.

An example of a connector having a terminal vibration preventing mechanism, which constitutes a first embodiment of the invention, will be described with reference to FIGS. 1 through 7. In those drawings, reference character 1 designates the connector 1. The latter 1 comprises: a housing 10; and connecting terminals 30 accommodated in the housing.

As shown in FIG. 1, the male-type connecting terminal 30 has an elongated tab-shaped contact section 31 at one end, a fixing section, namely, a punching section 32 at the other end which is used to fixedly hold a wire 40, and a box-shaped locking section 33 substantially at the middle. The punching section 32 comprises: a cover punching section 32*a* adapted to punch the cover of a wire; and a conductor punching section 32*b* adapted to punch the conductor of the wire. The locking section 33 has a locking hole 34 in the lower surface which is engaged with a flexible locking piece (described later), and a guide piece 35 on the side surface which is formed by cutting and raising a part of the lower surface so that it is slid along a guide groove in the housing. The coupling portion (at one end) between the tab-shaped contact section 31 and the locking section (substantially at the middle) is so shaped that the upper surface of the tab-shaped contact section 31 is lower than that of the locking section 33.

Figure 2:
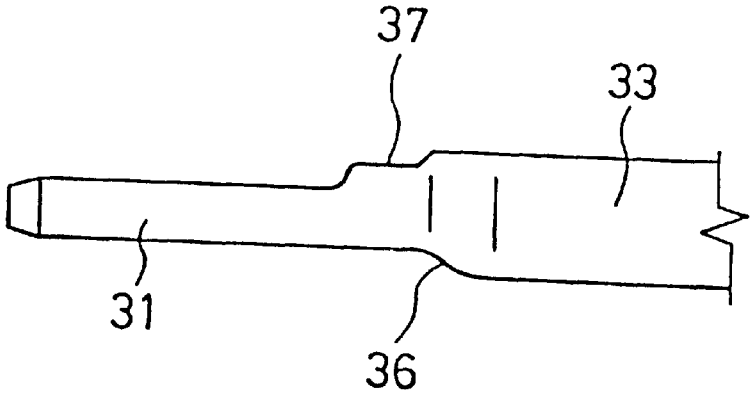
FIG. 2 is a plan view showing essential parts of the connecting terminal shown in FIG. 1.

As shown in FIG. 2, on one of the two sides the coupling section 36 is so shaped that it is narrower towards the tab-shaped contact section, while on the other side the vibration preventing piece 37 which is flush with the side surface of the locking section 36 is so formed that it is extended towards the tab-shaped contact section.

Figure 3:
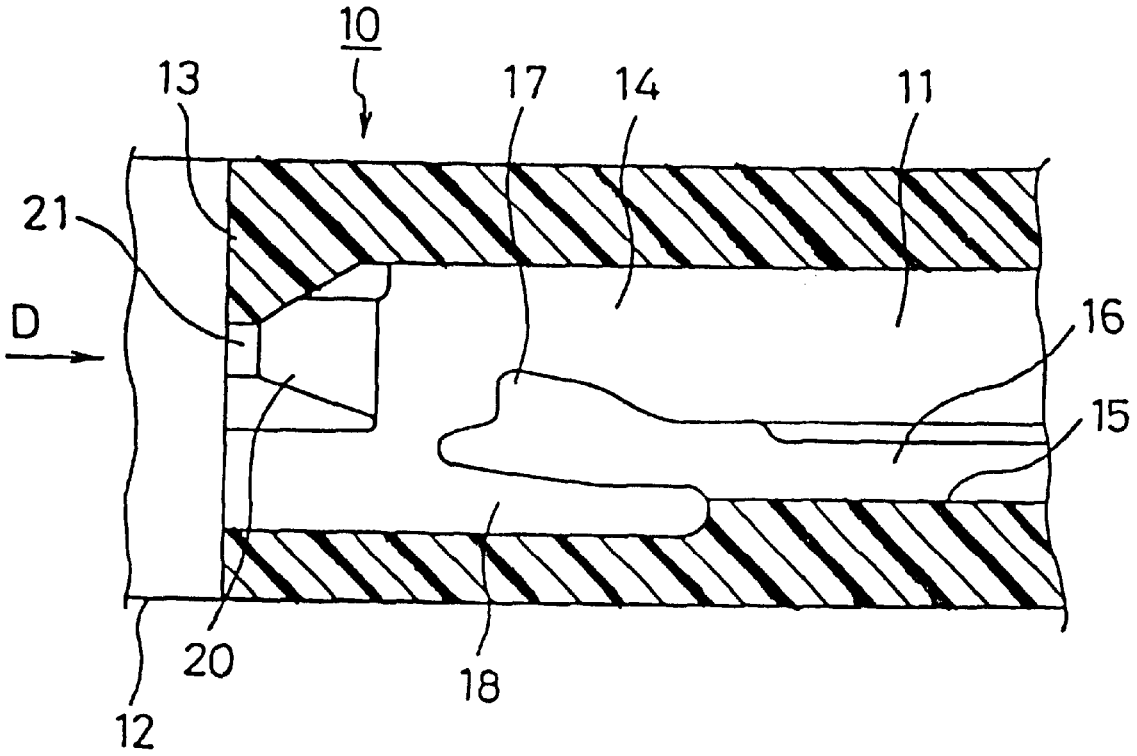
FIG. 3 is a vertical sectional view showing essential parts of a housing in the connector of the invention.
Figure 4:
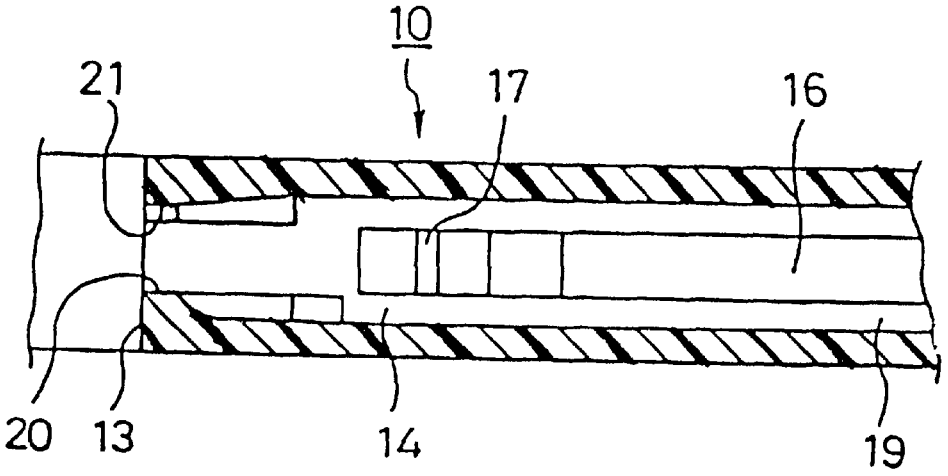
FIG. 4 is a horizontal sectional view showing essential parts of the housing in the connector of the invention.

As shown in FIGS. 3 and 4, the housing 10 has: a terminal accommodating chamber 11 at the rear side which is substantially cylindrical and is adapted to accommodate a connecting terminal 30; a hood section 12 which has an inflated section on the front side and is adapated to accommodate a mating connector; and an upright inner wall 13 at the deep in the hood section. In front of the terminal accommodating chamber 11, an engaging chamber 14 for a connecting terminal 30 is provided. On the lower surface 15 of the engaging room 14, a flexible locking piece 16 is formed in such a manner that it is extended forwardly. And its free end portion is formed into a locking protrusion 17. Below the locking protrusion 17, a bending space, namely, a flexible space 18 is provided.

Furthermore, in the lower surface of the terminal accommodating chamber 11, a guide groove (cf. FIG. 7) is extended along the flexible locking piece 16. A guide piece 35 of the connecting terminal 30 is slid along the guide groove. The inner wall 13 has a plurality of contact section engaging holes 20. Through the latter 20, the tab-shaped contact sections 31 of the connecting terminals which are accommodated in the terminal accommodating chambers are protruded into the hood section 12.

Figure 5:
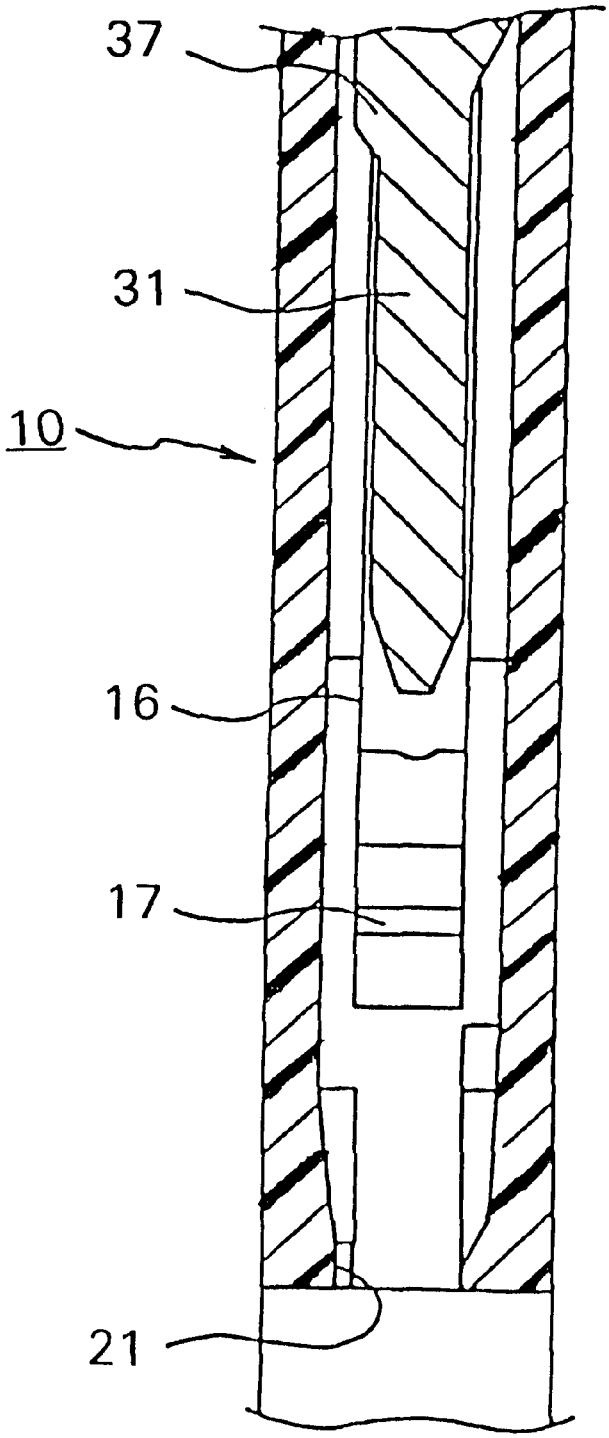
FIG. 5 is a sectional view showing essential parts of the connecting terminal inserted into the housing.

As shown in FIG. 5, the width of the tab-shaped contact section 31 is equal to or smaller than the width of the flexible locking piece 16.

Figure 6:
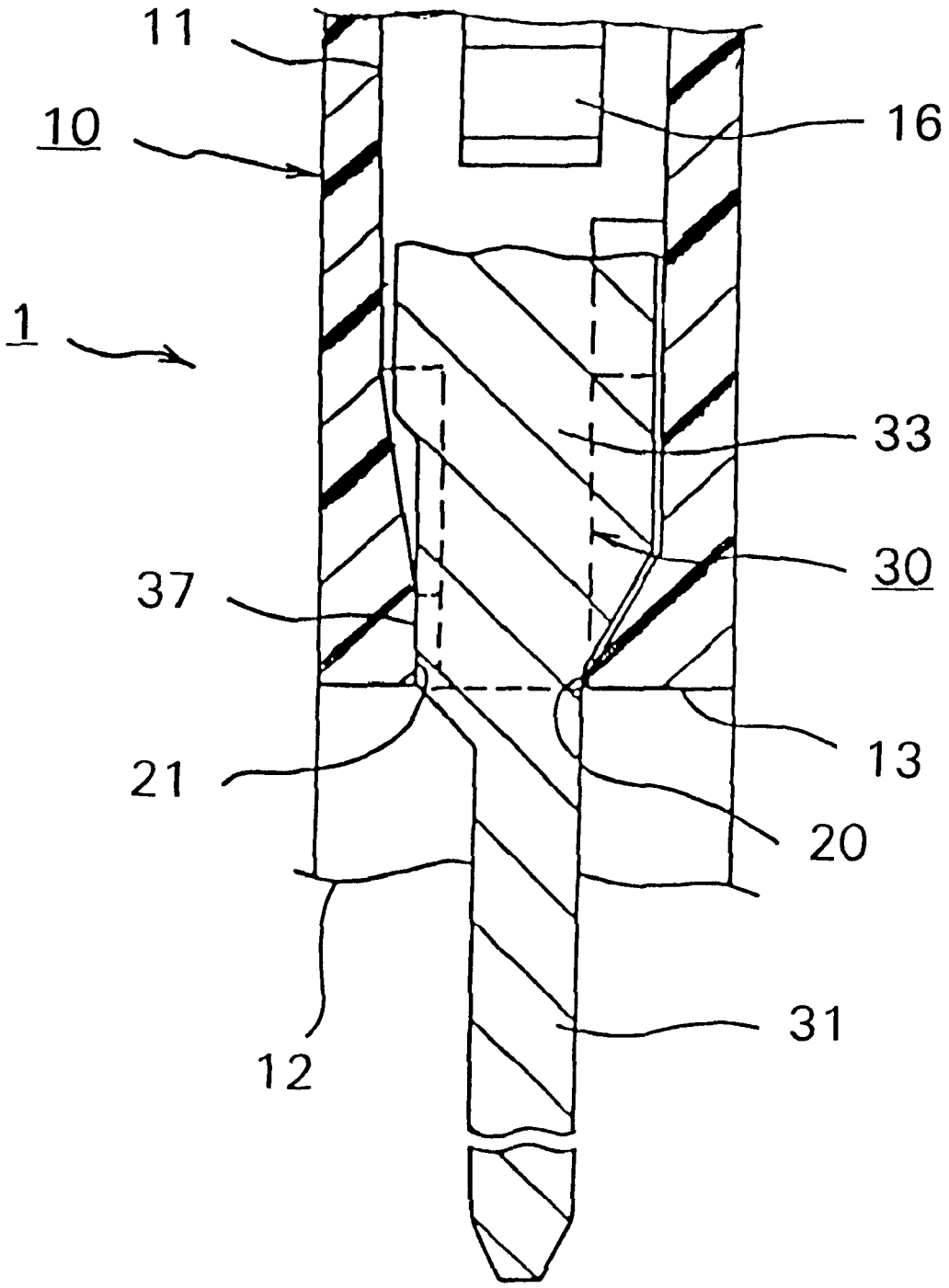
FIG. 6 is a sectional view showing essential parts of the connecting terminal which is inserted into the housing.
Figure 7:
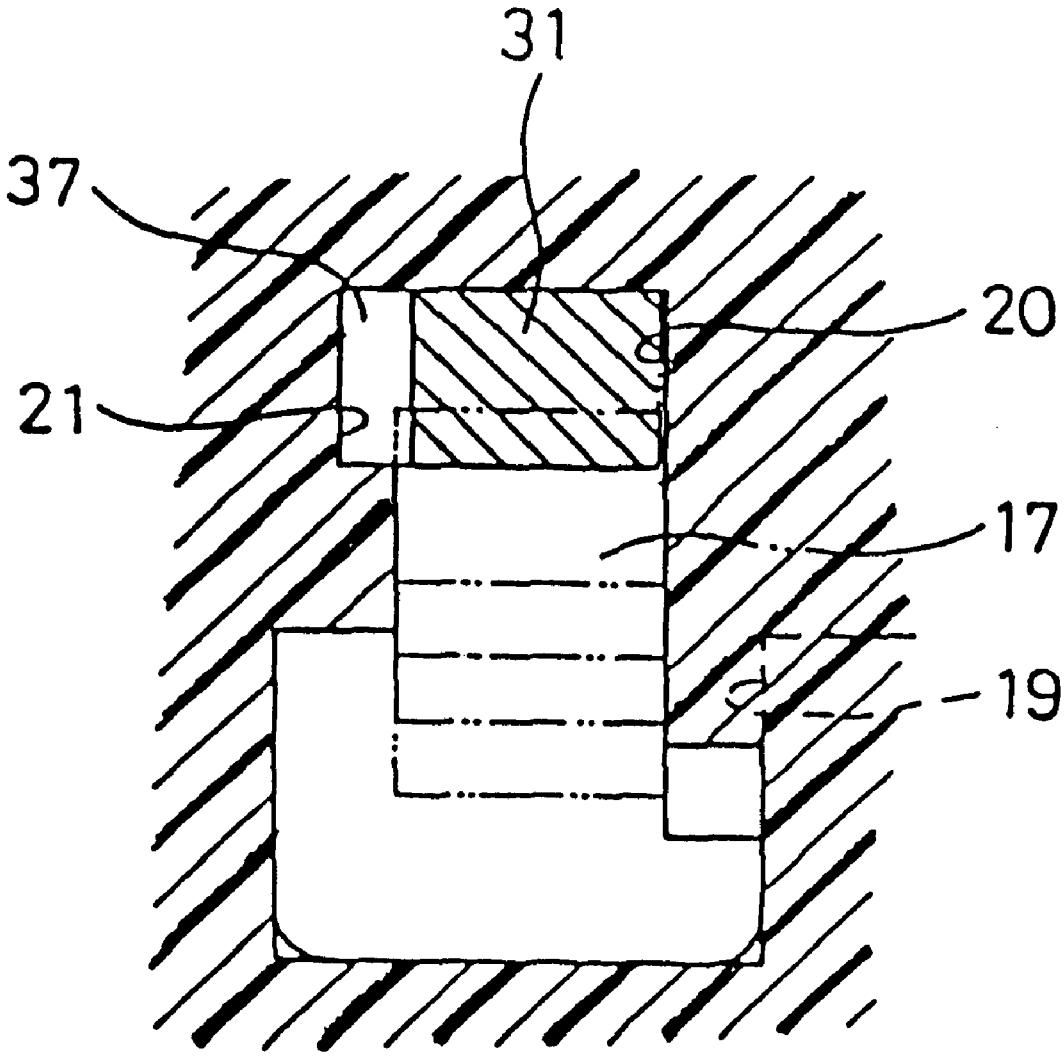
FIG. 7 is another sectional view showing essential parts of the connecting terminal which is inserted in the housing.

As shown in FIGS. 6 and 7, in the contact section engaging hole 20 has a contact recess 21 which serves as a support section into which the side surface of the vibration preventing piece 37 of the connecting terminal 30 is press-fitted. FIG. 7 is a view of the contact section engaging hole 20 (FIG. 3) taken in direction of the arrow D in FIG. 3; the vibration preventing piece 37 of the tab-shaped contact section 31 is press-fitted in the contact recess 21.

As was described above, the connector 1 with the terminal vibration preventing mechanism of the invention is designed as follows: That is, as was described above, on one side surface of the coupling section of the tab-shaped contact section 31 provided at one end of the connecting terminal 30, and the locking section 33 provided substantially at the middle, the vibration preventing piece 37 which is extended on the side surface of the locking section 33 and on the side of the tab-shaped contact section 31.

On the other hand, the contact section engaging hole 20 formed in the inner wall 13, which is formed between the terminal accommodating chamber 11 in the housing 10 and the hood section 12 in which a mating connector is inserted.

The width of the tab-shaped contact section 31 is equal to or smaller than that of the flexible locking piece 16, and the side surface of the vibration preventing piece is press-fitted into the contact recess 21.

Accordingly, as shown in FIGS. 6 and 7, the vibration preventing piece 37 of the connecting terminal, which is inserted into the terminal accommodating chamber 11 of the housing 10, is press-fitted in the wall surface of the contact recess 21 in the contact section engaging hole 20 of the housing side. This feature positively prevents, especially, the vertical vibration with respect to the regular position of the connecting terminal in the housing. Furthermore, since the width of the tab-shaped contact section 31 is equal to or smaller than that of the flexible locking piece 16, the miniaturization of both the connecting terminal 30 and the housing 10 can be achieved with ease.

As was described above, the connecting terminal 30 has the vibration preventing piece 37. Therefore, when the connecting terminal is inserted into the terminal accommodating chamber 11, the vibration preventing piece 37 is slid along the inner side wall of the terminal accommodating chamber 11 (cf. FIG. 5), so that the tab-shaped contact section 31 is guided to the regular position. Accordingly, the top portion, namely, the tab-shaped contact section 31 can be straightly inserted; that is, the insertion of the connecting terminal can be achieved smoothly.

Another example of the connector with the terminal vibration preventing mechanism, which constitutes a second embodiment of the invention, will be described with reference to FIGS. 8 through 12.

Figure 8:
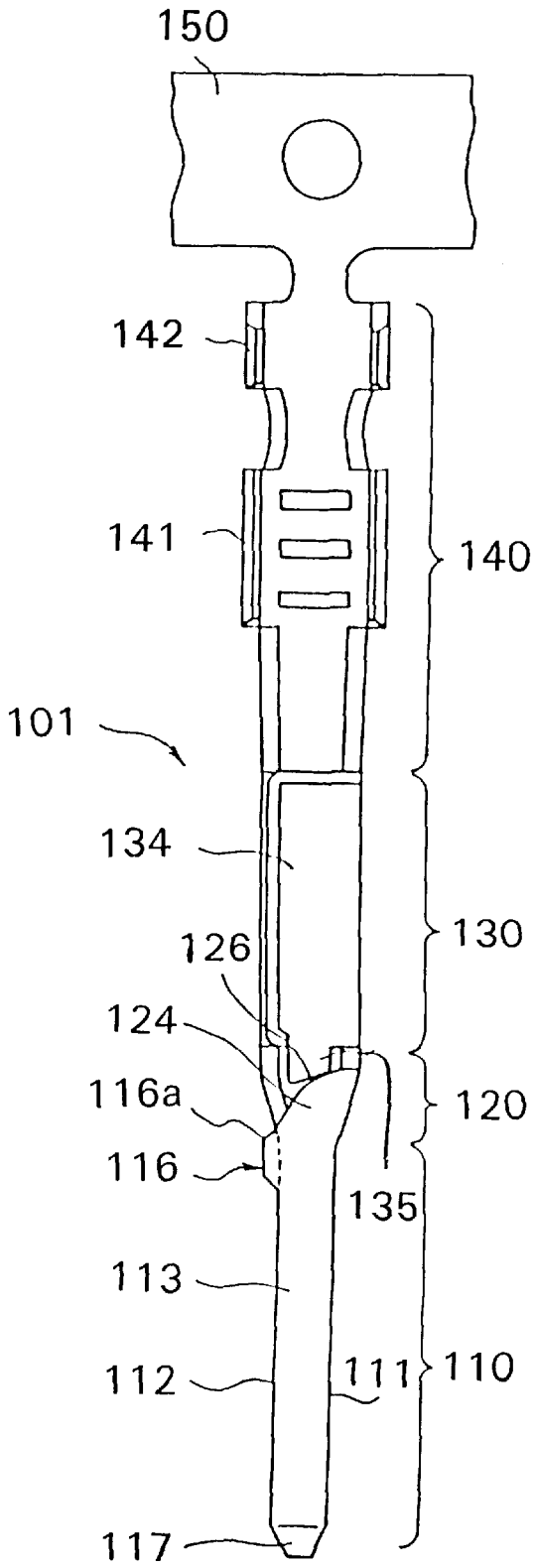
FIG. 8 is a plan view of a connecting terminal of another example of the connector with the terminal vibration preventing mechanism, which constitutes a second embodiment of the invention.
Figure 9:
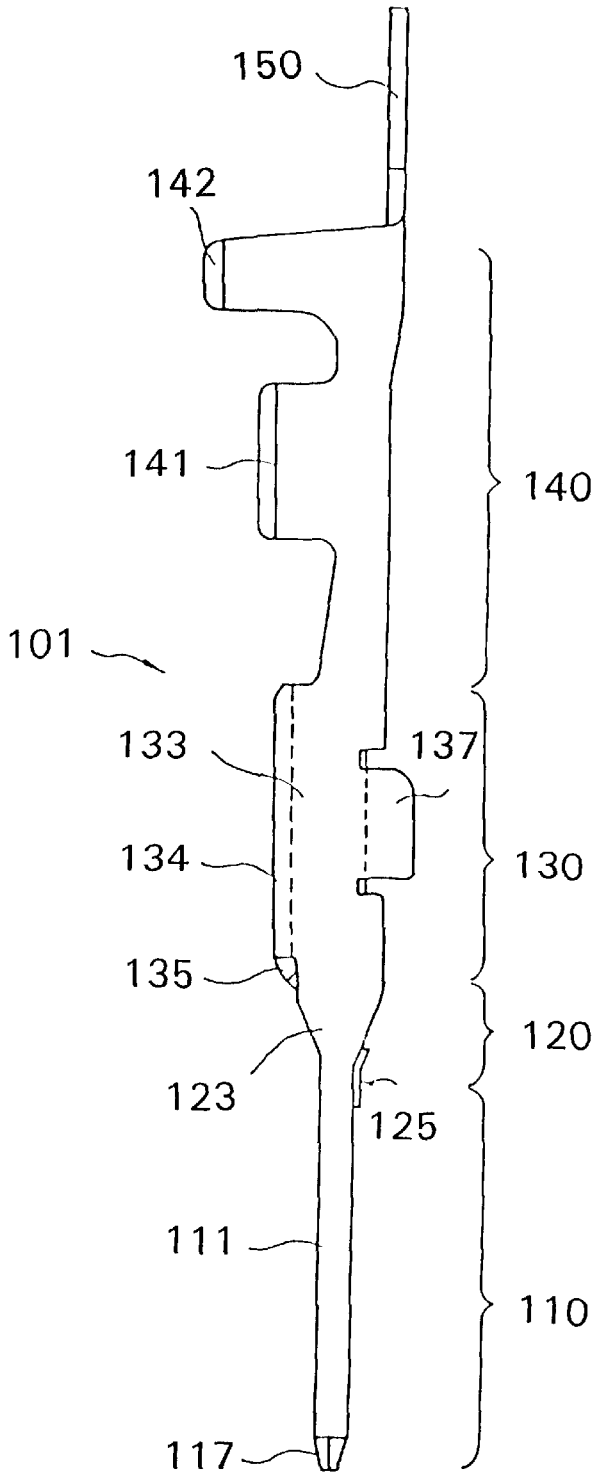
FIG. 9 is a side view of the connecting terminal shown in FIG. 8.
Figure 17A:
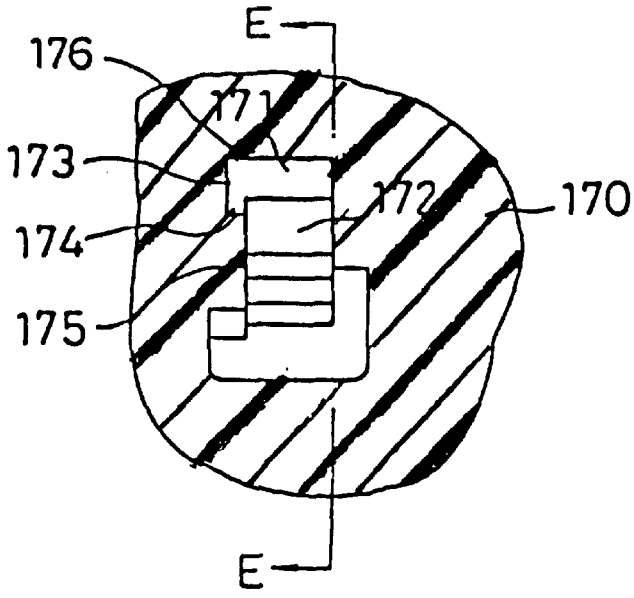
FIG. 17 shows a connector housing in the embodiment of the invention. More specifically, the part (A) of FIG. 17 is a front view showing essential parts of the inlet end face of a mating connecting terminal of the connector housing, and the part (B) of FIG. 17 is a fragmentary sectional view taken along line E—E in the part (A).
Figure 17B:
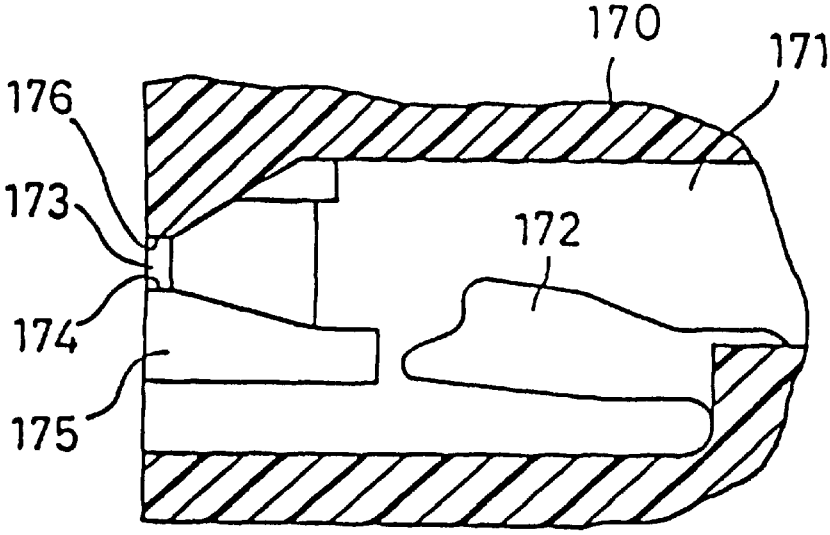
Figure 18:
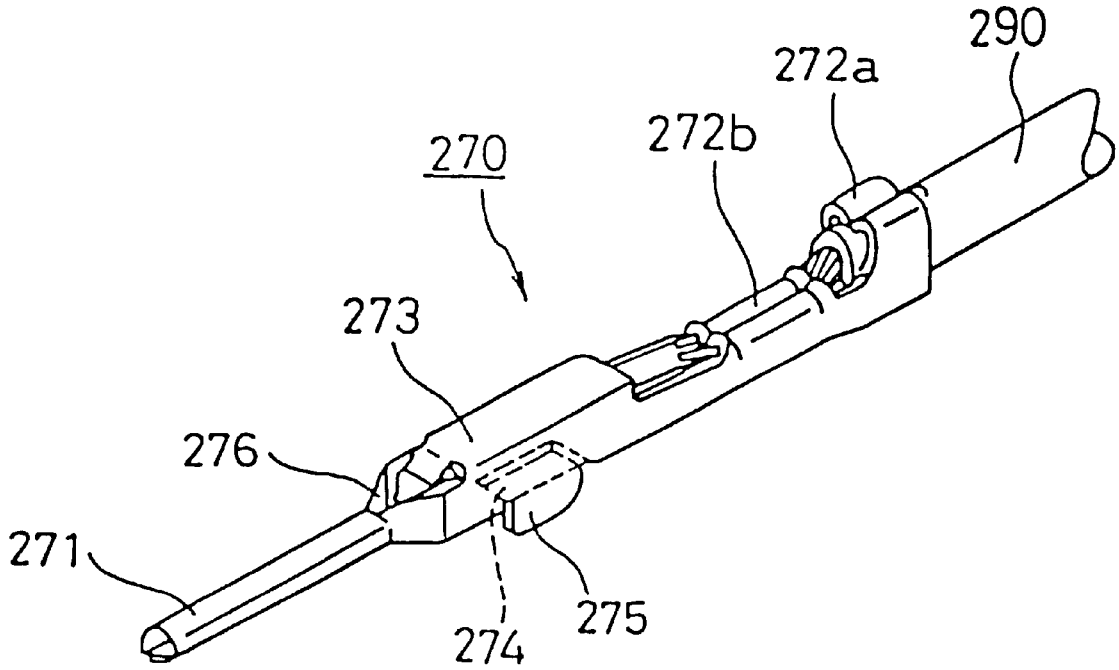
FIG. 18 is a perspective view of a connecting terminal forming a conventional connector.
Figure 19:
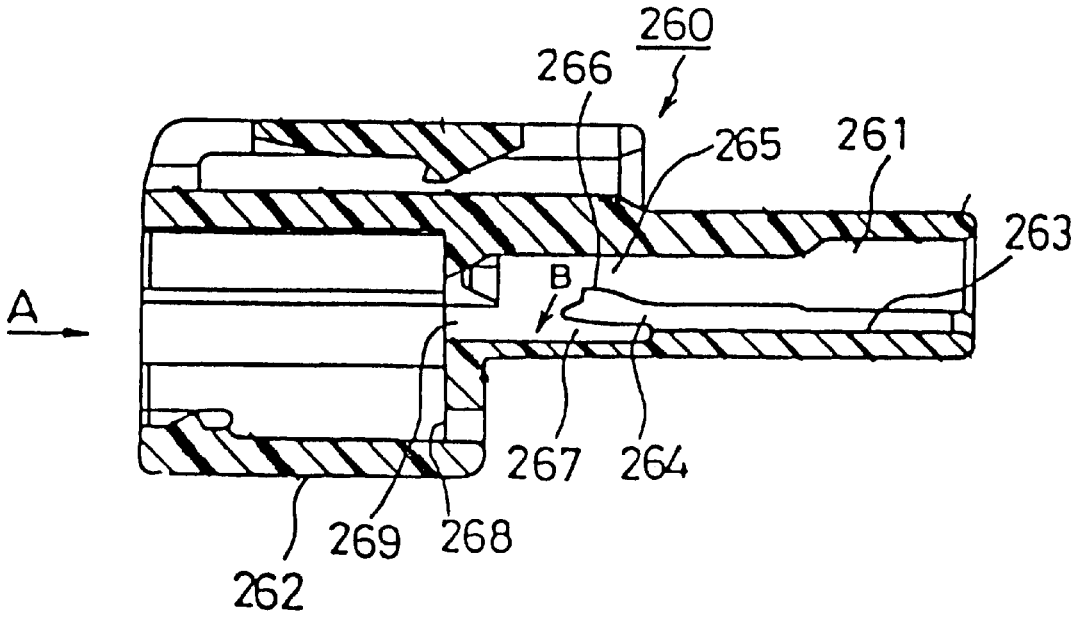
FIG. 19 is a sectional view of a housing forming the conventional connector.
Figure 20:
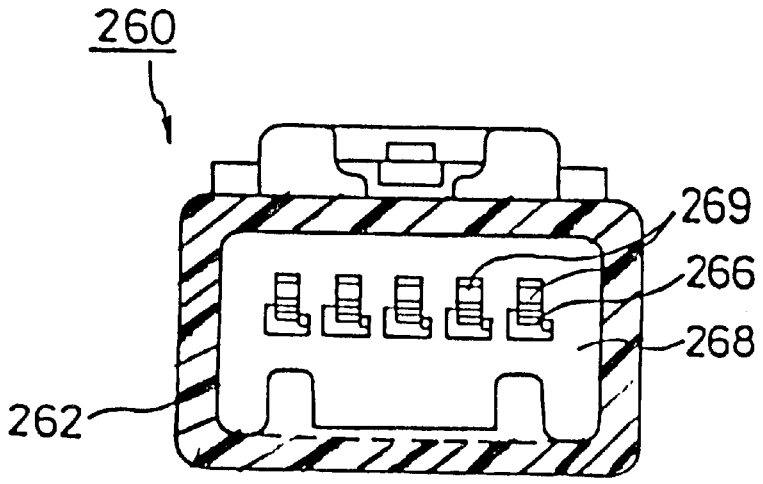
PRIOR ART FIG. 20
FIG. 20 is a diagram of the housing as viewed in the direction of the arrow A in FIG. 19.
Figure 21:
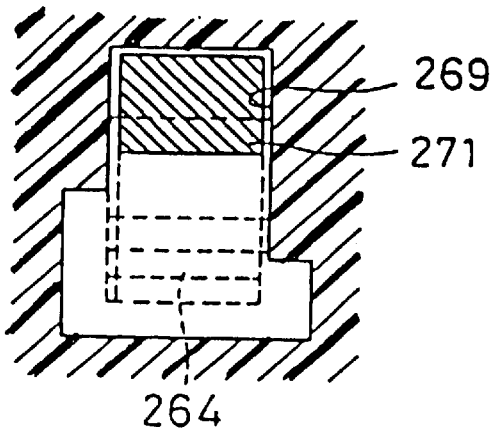
FIG. 21 is a fragmentary enlarged sectional view showing essential parts of the housing shown in FIG. 20.
Figure 22:
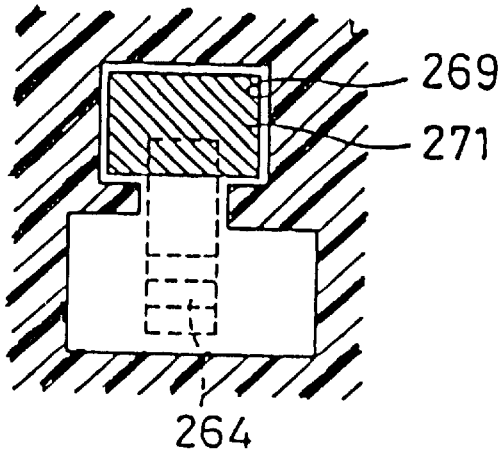
PRIOR ART FIG. 22
FIG. 22 is a fragmentary sectional view of a housing showing another arrangement of the conventional connector.
Figure 23:
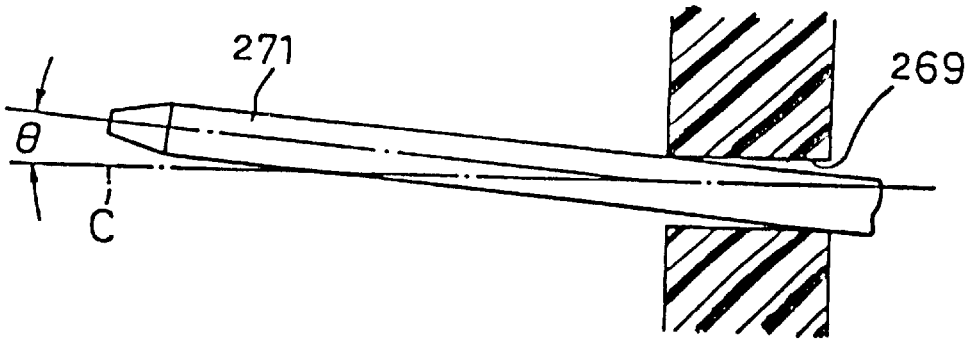
PRIOR ART FIG. 23
FIG. 23 is an enlarged diagram showing a state of insertion of a terminal in the conventional connector.

As shown in FIGS. 8 and 9, the connecting terminal 101 of the connector with the terminal vibration preventing mechanism, the second embodiment comprises: a punching section 140 including a cover punching section 142 adapted to punch the end portion of the cover of a wire, and a conductor punching section 141 adapted to punch the conductor of the wire; a tab-shaped contact section 110 brought into contact with a mating connecting terminal; a locking section 130 which is provided between the punching section 140 and the tab-shaped contact section 110 and which, when it is accommodated in the connector housing (cf. FIG. 17, is engaged with the flexible locking piece provided in the terminal accommodating chamber; and a coupling section 120 through which the locking section 130 is coupled to the tab-shaped contact section 110. The connecting terminal is formed by blanking a metal sheet and bending it. In FIGS. 8 and 9, reference numeral 150 designates a belt-shaped carrier strip, which is cut when the connecting terminal is assembled.

Figure 10:
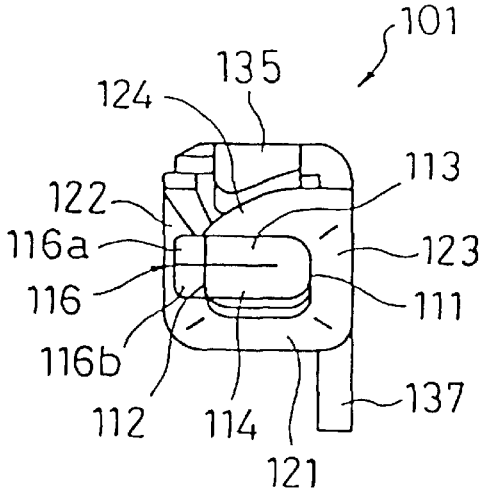
FIG. 10 is a front view of the connecting terminal shown in FIG. 8 as viewed from the front end thereof.
Figure 11:
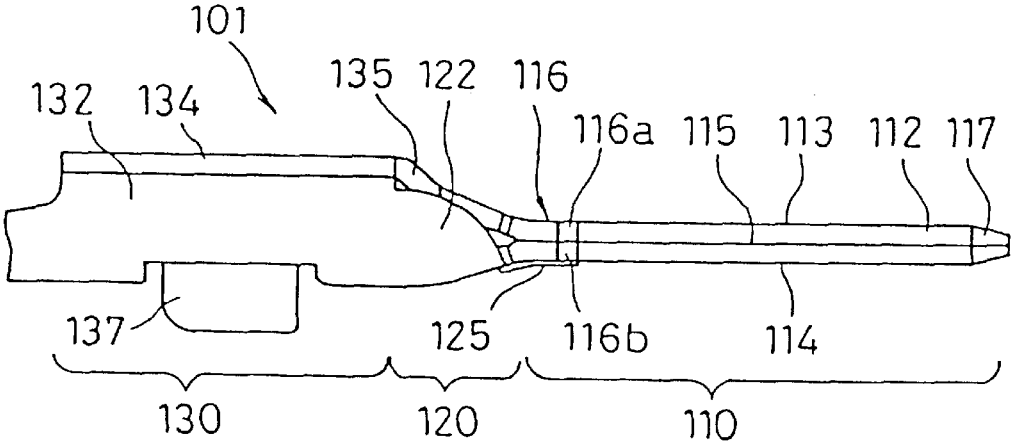
Figure 12:
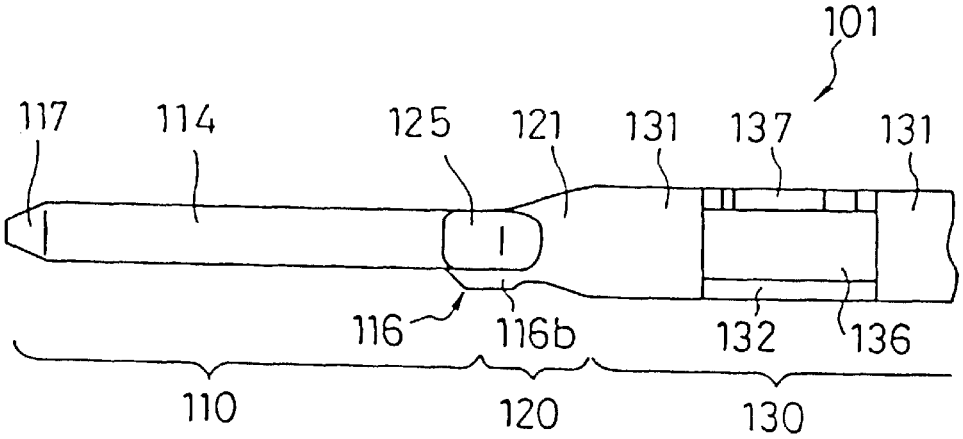
FIG. 12 is a fragmentary bottom view of the connecting terminal shown in FIG. 8.

The tab-shaped contact section 110, as shown in FIGS. 10 through 12, comprises a lower metal plate 114, and an upper metal plate 113 which is formed by folding one side edge portion 111 of the lower metal plate 114, in such a manner that the surface 115 formed by putting together the lower metal plate 114 and the upper metal plate 113 is faced sidewardly at a position along the opposite side edge portion 112. There is no gap between the lower metal plate 114 and the upper metal plate 113. Hence, the tab-shaped contact section is high in mechanical strength or rigidity.

The end portion 117 of the tab-shaped contact section 110 is tapered so as to guide the mating connecting terminal.

From the base portion near the coupling section 120 of the tab-shaped contact section 110, a vibration preventing piece 116 is protruded. The vibration preventing piece 116 abuts against the upper surface 176 and the lower surface 174 of the contact section engaging hole 173 formed in the terminal accommodating chamber 171 of the connector housing **170*b* (cf. FIG. 17), thereby to prevent the vertical vibration of the end portion 117. This vibration preventing piece 116 is protruded from the opposite side edge 112 of the tab-shaped contact section 110 where the surface 115 is located which is formed by folding the upper metal plate 113 and the lower metal plate 114 (hereinafter referred to as "a folded surface 115", when applicable). And the vibration preventing piece 116 is made up of a lower prevention piece 116*b* protruded from the lower metal plate 114, and an upper prevention piece 116*a* which is protruded from the upper metal plate 113 and folded over the lower prevention piece 116*b***.

The upper surface of the upper prevention piece **116*a* and the lower surface of the lower prevention piece 116*b* are on the upper surface of the upper metal plate 113 and the lower surface of the lower metal plate 114, respectively. As is apparent from the above description, the vibration preventing piece 116 is not protruded from one side edge 111 where the lower metal plate 114 is folded, but protruded from the other side edge 112 where the joint 115 is located. Therefore, the vibration preventing piece 116** can be formed readily by blanking and bending a metal plate.

The aforementioned locking section 130 is substantially in the form of a box having a bottom wall 131, a pair of side walls 132 and 133 extended upwardly from both sides of the bottom wall 131, and an upper wall 134 bent inwardly from the side wall 133. The bottom wall of the locking section 130 has a locking hole 136 with which a flexible locking piece of the connector housing is engaged. The side wall 133 has a guide piece 137 which is extended downwardly from the bottom wall 131.

The aforementioned coupling section 120 comprises a bottom plate 121, a side plate 122, a side plate 123, and an upper plate 124. The bottom plate 121 is reduced from the locking section 130 towards the tab-shaped contact section 110, and extended from the bottom wall 131 of the locking section 130 towards the lower metal plate 114 of the tab-shaped contact section 110. The side plate 122 is extended from the side wall 132 of the locking section 130 towards the other side edge 112 of the lower metal plate 114 of the tab-shaped contact section 110. The side plate 123 is extended from the other side wall 133 towards one side edge 111 of the tab-shaped contact section 110. The upper plate 124 is bent inwardly from the other side wall 133 of the locking section 130 and extended towards the upper metal plate 113 of the tab-shaped contact section 110.

The rear end edge 126 of the upper plate 124 is cut obliquely from one side edge 111 of the tab-shaped contact section 110 toward the opposite side edge 112. Therefore, the connecting terminal 101 can be subjected to drawing, and the coupling section 120 can be formed by drawing.

Hence, the tab-shaped contact section 110 is positively supported by the locking section 130 with the aid of the coupling section 120, thus being greatly resistive against bending action.

A reinforcing bead 125 is formed near the coupling section 120 of the lower metal plate 114 of the tab-shaped contact section 110. A gap is formed between the upper wall 134 of the locking section 130 and the upper plate 124 of the coupling section 120; however, since, at the front end of the upper plate 134, a tongue piece 135 whose configuration is complementary with that of the rear end edge 126 of the upper plate 124 is protruded towards the rear end edge 126, the gap between the coupling section 120 and the locking section 130 is closed.

One modification of the connecting terminal, the embodiment of the invention, will be described with reference to FIGS. 13 through 16.

Figure 13:
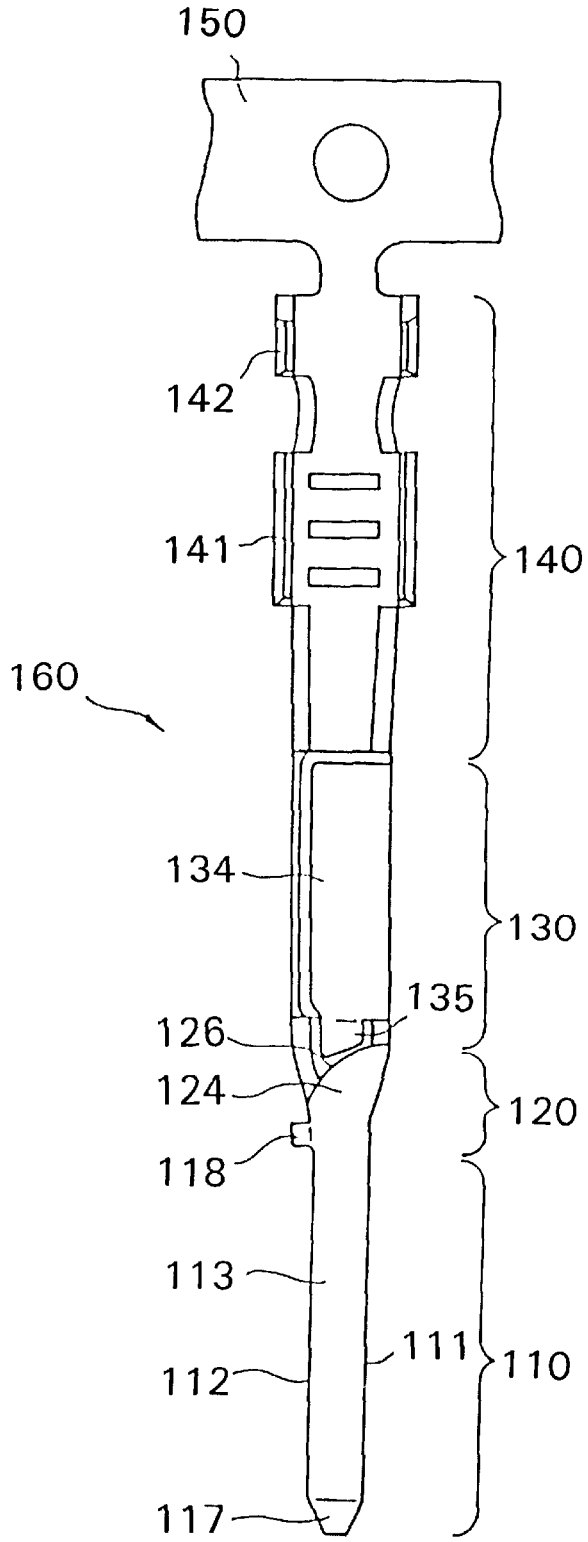
FIG. 13 is a plan view of the connecting terminal shown in FIG. 8.
Figure 14:
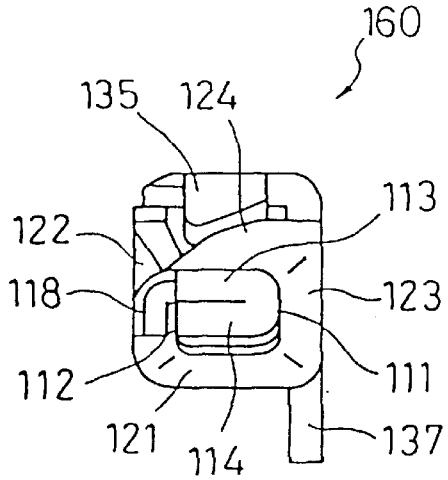
FIG. 14 is a front view of the connecting terminal shown in FIG. 13, as viewed from the front end thereof.
Figure 15:
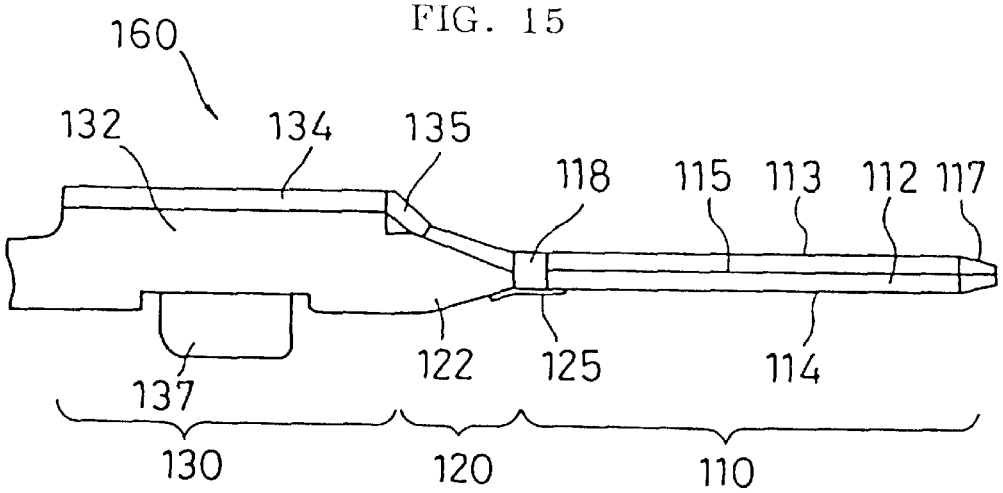
FIG. 15 is a fragmentary side view of the connecting terminal shown in FIG. 13.
Figure 16:
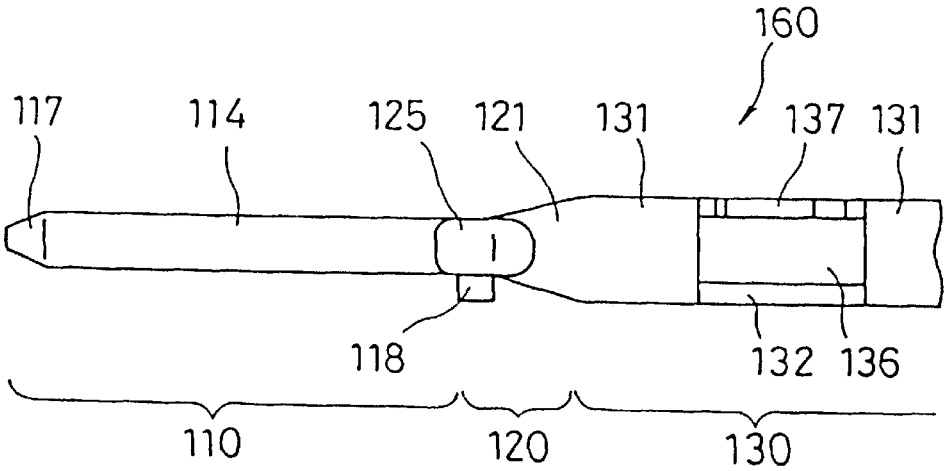
FIG. 16 is a fragmentary bottom view of the connecting terminal shown in FIG. 13.

As is seen in FIG. 13, a connecting terminal 160 is fundamentally equal in arrangement to the above-described 101, the first embodiment of the invention. The modification is different from the first embodiment only in the arrangement of the vibration preventing piece 118. Hence, only the arrangement of the latter 118 will be described.

The vibration preventing piece 118, similarly as in the case of the above-described vibration preventing piece 116, is the base section near the coupling section of the tab-shaped contact section 110, and it is protruded from the opposite side edge 112 of the tab-shaped contact section 110 where the joint 115 of the upper metal plate 113 and the lower metal plate 114 is located. However, it should be noted that the vibration preventing piece is different from the vibration preventing piece 116 of the connecting terminal 101 in that it is protruded only from the upper metal plate 113, and is bent until the end surface is flush with the lower surface of the lower metal plate 114.

The vibration preventing piece 118 is formed by using the upper metal plate 113 by bending. Hence, unlike the case of the vibration preventing piece the above-described connecting terminal 101, the vertical height of the end surface of the vibration preventing piece 118 can be adjusted.

FIG. 17 shows the connector housing of the above-described embodiment of the invention. More specifically, the part (A) of FIG. 17 is a front view showing essential parts of the inlet side end face of the mating connecting terminal of the connector housing, and the part (B) of FIG. 17 is a vertical sectional view, with parts cut away, taken along line E—E in the part (A).

As shown in FIG. 17, the connector housing 170 has a terminal accommodating chamber 171 adapted to accommodate a connecting terminal 101 or 160 in such a manner that the chamber 171 is extended backwardly (to the right in the part (B) of FIG. 17) from the inlet side end face of the mating connecting terminal. The bottom of the terminal accommodating chamber 171 has a flexible locking piece 172 adapted to engaged with the locking hole 136 of the connecting terminal 101 or 160. The flexible locking piece 172 is protruded forwardly. The upper part of the inlet side end face of the mating connecting terminal of the terminal accommodating chamber 171 has a contact section engaging hole 173 which is shifted to the left (to the left in the part (A) of FIG. 17) more than the inlet-side side wall 175 of the mating terminal of the terminal accommodating chamber 171.

The vertical width of the contact section engaging hole 173 is substantially equal to the vertical width of the vibration preventing piece 116 or 118 of the connecting terminal 101 or 160. In the case where the terminal 101 or 160 is accommodated in the terminal accommodating chamber 171, and the locking section 130 of the connecting terminal 101 or 160 is engaged with the flexible locking piece 172, the vibration preventing piece 116 or 118 of the connecting terminal 101 or 160 is positioned in the contact section engaging hole 173, and the upper surface of the contact section engaging hole 173 is brought into contact with the upper surface of the vibration preventing piece 116 or 118 while the lower surface 174 thereof is brought into contact with the lower surface of the vibration preventing piece 116 or the front end face of the vibration preventing piece 118, whereby the vertical vibration of the end 117 of the tab-shaped contact section 110 of the connecting terminal 101 or 160 is prevented. Hence, when the connecting terminal 101 or 106 is accommodated in the connector housing 170, the position of the end of the tab-shaped contact section 110 is not swung vertically, and suitably engaged therewith when the tab-shaped contact section 110 is engaged with the mating connecting terminal. Particularly, in order to protrude the flexible locking piece 172 inside the terminal accommodating chamber 171 of the connector housing 170 by molding, a space is necessary which is located lower than the portion in which the connecting terminal 101 or 106 is inserted, and if the vibration preventing piece 116 or 118 is not present, the connecting terminal 101 or 160 is liable to vibrate downwardly. Accordingly, the invention is effective particularly in the fact that the lower surface of the vibration preventing piece 116 or the front end face of the vibration preventing piece 118 abuts against the lower surface of the contact section engaging hole 173, thereby to prevent the downward vibration of the tab-shaped contact section 110.

What is claimed is:

1. A connector having a vibration preventing mechanism with a connecting terminal inserted into a terminal accommodating chamber of a resin housing, said connector comprising:

an elongated tab-shaped contact section which is inserted into a hood section, a fixing section adapted to fix an end portion of a wire, and a locking section having a locking hole in a lower surface of a substantially middle portion thereof which is engaged with a flexible locking piece formed in said housing;

a contact section engaging hole formed in an inner wall forming a deep section of said hood section which is adapted to engage a mating connector, and in which said tab-shaped contact section is inserted;

a vibration preventing piece extending towards said tab-shaped contact section near a junction of said tab-shaped contact section of said connecting terminal and said locking section, said vibration preventing piece being flush with a side surface of said tab-shaped contact section;

a coupling section connecting said locking section and said tab-shaped contact section, said coupling section comprising a first side forming a forward slope in an axial direction from said locking section towards said tab-shaped contact section, and a second side opposed to said first side for supporting said vibration preventing piece such that said vibration preventing piece is flush with a side surface of said locking section; and a support section formed in a side surface of said contact section engaging hole in said housing and against which said vibration preventing piece is abutted, wherein said support section forms a recess into which a side surface of said vibration preventing piece is fitted to prevent vibration in a direction perpendicular to an insertion direction of said elongated tab-shaped contact section.

2. A connector having a vibration preventing mechanism as claimed in claim 1, wherein a width of said tab-shaped contact section is equal to or smaller than the width of said flexible locking piece.

3. A connector having a vibration preventing mechanism as claimed in claim 1, wherein said vibration preventing piece of said tab-shaped contact section is supported by said support section in a press-fit mode.

4. The connector having a vibration preventing mechanism as claimed in claim 1, wherein said vibration preventing piece extends on a side surface of said locking section and on a side of said tab-shaped contact section.

5. A connector having a vibration preventing mechanism comprising:

a tab-shaped contact section which is contactable with a mating connecting terminal;

a locking section which, when accommodated in a connector housing, is engaged with a terminal accommodating chamber, and a coupling section through which said locking section is coupled to said tab-shaped contact section, said tab-shaped contact section comprising a lower metal plate, and an upper metal plate which is formed by folding one side edge portion of said lower metal plate;

a connecting terminal is inserted such that a joint of said lower metal plate and said upper metal plate is faced sidewardly at a position along an opposite side edge; and a vibration preventing piece abuts against said connector housing to prevent vertical vibration of an end of said tab-shaped contact section and protrudes adjacent said coupling section of said tab-shaped contact section, wherein said vertical vibration is in a direction perpendicular to an insertion direction of said elongated tab-shaped contact section, and wherein said coupling section connecting said locking section and said tab-shaped contact section comprises a first side forming a forward slope in an axial direction from said locking section towards said tab-shaped contact section, and a second side opposed to said first side for supporting said vibration preventing piece such that said vibration preventing piece is flush with a side surface of said locking section.

6. A connector having a vibration preventing mechanism as claimed in claim 5, wherein said vibration preventing piece protrudes from the side edge of said tab-shaped contact section where the joint of said upper metal plate and said lower metal plate is located.

7. The connector having a vibration preventing mechanism as claimed in claim 5, wherein said vibration preventing piece is protruded exclusively from said upper metal plate and forms a bend such that an end surface is flush with a lower surface of said lower metal plate.

* * * * *